US006148697A

United States Patent [19]

Perry et al.

[11] Patent Number: 6,148,697

[45] Date of Patent: Nov. 21, 2000

[54] SCREWGUN EXTENSION

[76] Inventors: Joseph N. Perry, 6811 Sunnyvale La. #H, Greenville, Wis. 54942; Ed Lemke, 514 Dove St., Oshkosh, Wis. 54901

[21] Appl. No.: 09/234,643

[22] Filed: Jan. 21, 1999

[51] Int. Cl.[7] ..... B25B 23/00

[52] U.S. Cl. ..... 81/177.2; 81/180.1

[58] Field of Search ..... 81/177.2, 177.85, 81/177.1, 180.1, 52, 54, 53.1, 57.37, 430–435

[56] References Cited

U.S. PATENT DOCUMENTS

| | | | |
|---|---|---|---|
| 3,267,773 | 8/1966 | Irwin et al. | 81/52 |
| 3,960,191 | 6/1976 | Murray | 81/57.37 |
| 5,285,702 | 2/1994 | Hillinger | 81/177.2 |

*Primary Examiner*—D. S. Meislin

[57] ABSTRACT

A screwgun extension for extending the reach of a screwgun to permit a user to turn screws located a greater distance from the screwgun than could be reached with the rotating chuck of the screwgun alone. The screwgun extension includes an elongate tube with opposite open proximal and distal ends. The proximal end of the tube is designed for receiving a chuck of a rotary tool therein. The tube has an arcuate bulbous collar adjacent the proximal end of the tube which has a convex outer surface outwardly extending from the exterior surface of the tube. An elongate drive shaft is disposed in the lumen of the tube. A first end of the drive shaft is extended towards the proximal end of the tube. A second end of drive shaft is outwardly extended from the distal end of the tube The first end of the drive shaft is designed for clamping between jaws of a chuck of a rotary tool inserted into the proximal end of the tube such that rotation of the chuck rotates the drive shaft. A bushing is inserted into the distal end of the tube and disposed around the drive shaft. The second end of the shaft is designed for engaging a head of a fastener to permit rotation of the fastener when the drive shaft is rotated.

1 Claim, 2 Drawing Sheets

SCREWGUN EXTENSION

BACKGROUND OF THE INVENTION

1. Field of the Invention

The present invention relates to extensions for screwguns and more particularly pertains to a new screwgun extension for extending the reach of a screwgun to permit a user to turn screws located a greater distance from the screwgun than could be reached with the rotating chuck of the screwgun alone.

2. Description of the Prior Art

The use of extensions for screwguns is known in the prior art. More specifically, extensions for screwguns heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,397,412 by Dewey; U.S. Pat. No. 4,510,826 by Marks; U.S. Pat. No. 3,960,191 by Murray; U.S. Pat. No. 4,236,555 by Dewey; U.S. Pat. No. 1,793,236 by McDonough; and U.S. Pat. No. Des. 353,756 by Graves.

While these devices fulfill their respective, particular objectives and requirements, the aforementioned patents do not disclose a new screwgun extension. The inventive device includes an elongate tube with opposite open proximal and distal ends. The proximal end of the tube is designed for receiving a chuck of a rotary tool therein. The tube has an arcuate bulbous collar adjacent the proximal end of the tube which has a convex outer surface outwardly extending from the exterior surface of the tube. An elongate drive shaft is disposed in the lumen of the tube. A first end of the drive shaft is extended towards the proximal end of the tube. A second end of drive shaft is outwardly extended from the distal end of the tube The first end of the drive shaft is designed for clamping between jaws of a chuck of a rotary tool inserted into the proximal end of the tube such that rotation of the chuck rotates the drive shaft. A bushing is inserted into the distal end of the tube and disposed around the drive shaft. The second end of the shaft is designed for engaging a head of a fastener to permit rotation of the fastener when the drive shaft is rotated.

In these respects, the screwgun extension according to the present invention substantially departs from the conventional concepts and designs of the prior art, and in so doing provides an apparatus primarily developed for the purpose of extending the reach of a screwgun to permit a user to turn screws located a greater distance from the screwgun than could be reached with the rotating chuck of the screwgun alone.

SUMMARY OF THE INVENTION

In view of the foregoing disadvantages inherent in the known types of extensions for screwguns now present in the prior art, the present invention provides a new screwgun extension construction wherein the same can be utilized for extending the reach of a screwgun to permit a user to turn screws located a greater distance from the screwgun than could be reached with the rotating chuck of the screwgun alone.

The general purpose of the present invention, which will be described subsequently in greater detail, is to provide a new screwgun extension apparatus and method which has many of the advantages of the extensions for screwguns mentioned heretofore and many novel features that result in a new screwgun extension which is not anticipated, rendered obvious, suggested, or even implied by any of the prior art extensions for screwguns, either alone or in any combination thereof.

To attain this, the present invention generally comprises an elongate tube with opposite open proximal and distal ends. The proximal end of the tube is designed for receiving a chuck of a rotary tool therein. The tube has an arcuate bulbous collar adjacent the proximal end of the tube which has a convex outer surface outwardly extending from the exterior surface of the tube. An elongate drive shaft is disposed in the lumen of the tube. A first end of the drive shaft is extended towards the proximal end of the tube. A second end of drive shaft is outwardly extended from the distal end of the tube The first end of the drive shaft is designed for clamping between jaws of a chuck of a rotary tool inserted into the proximal end of the tube such that rotation of the chuck rotates the drive shaft. A bushing is inserted into the distal end of the tube and disposed around the drive shaft. The second end of the shaft is designed for engaging a head of a fastener to permit rotation of the fastener when the drive shaft is rotated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded ;Is including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new screwgun extension apparatus and method which has many of the advantages of the extensions for screwguns mentioned heretofore and many novel features that result in a new screwgun extension which is not anticipated, rendered obvious, suggested, or even implied by any of the prior art extensions for screwguns, either alone or in any combination thereof.

It is another object of the present invention to provide a new screwgun extension which may be easily and efficiently manufactured and marketed.

It is a further object of the present invention to provide a new screwgun extension which is of a durable and reliable construction.

An even further object of the present invention is to provide a new screwgun extension which is susceptible of a low cost of manufacture with regard to both materials and labor, and which accordingly is then susceptible of low prices of sale to the consuming public, thereby making such screwgun extension economically available to the buying public.

Still yet another object of the present invention is to provide a new screwgun extension which provides in the apparatuses and methods of the prior art some of the advantages thereof, while simultaneously overcoming some of the disadvantages normally associated therewith.

Still another object of the present invention is to provide a new screwgun extension for extending the reach of a screwgun to permit a user to turn screws located a greater distance from the screwgun than could be reached with the rotating chuck of the screwgun alone.

Yet another object of the present invention is to provide a new screwgun extension which includes an elongate tube with opposite open proximal and distal ends. The proximal end of the tube is designed for receiving a chuck of a rotary tool therein. The tube has an arcuate bulbous collar adjacent the proximal end of the e tube which has a convex outer surface outwardly extending from the exterior surface of the tube. An elongate drive shaft is disposed in the lumen of the tube. A first end of the drive shaft is extended towards the proximal end of the tube. A second end of drive shaft is outwardly extended from the distal end of the tube The first end of the drive shaft is designed for clamping between jaws of a chuck of a rotary tool inserted into the proximal end of the tube such that rotation of the chuck rotates the drive shaft. A bushing is inserted into the distal end of the tube and disposed around the drive shaft. The second end of the shaft is designed for engaging a head of a fastener to permit rotation of the fastener when the drive shaft is rotated.

Still yet another object of the present invention is to provide a new screwgun extension that lets a user reach a screw about six feet away from the user and that is lightweight to permit a user to easily lift a screwgun with the extension attached thereto.

Even still another object of the present invention is to provide a new screwgun extension that let a user stand on the ground and still be able to turn screws located on a ceiling.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
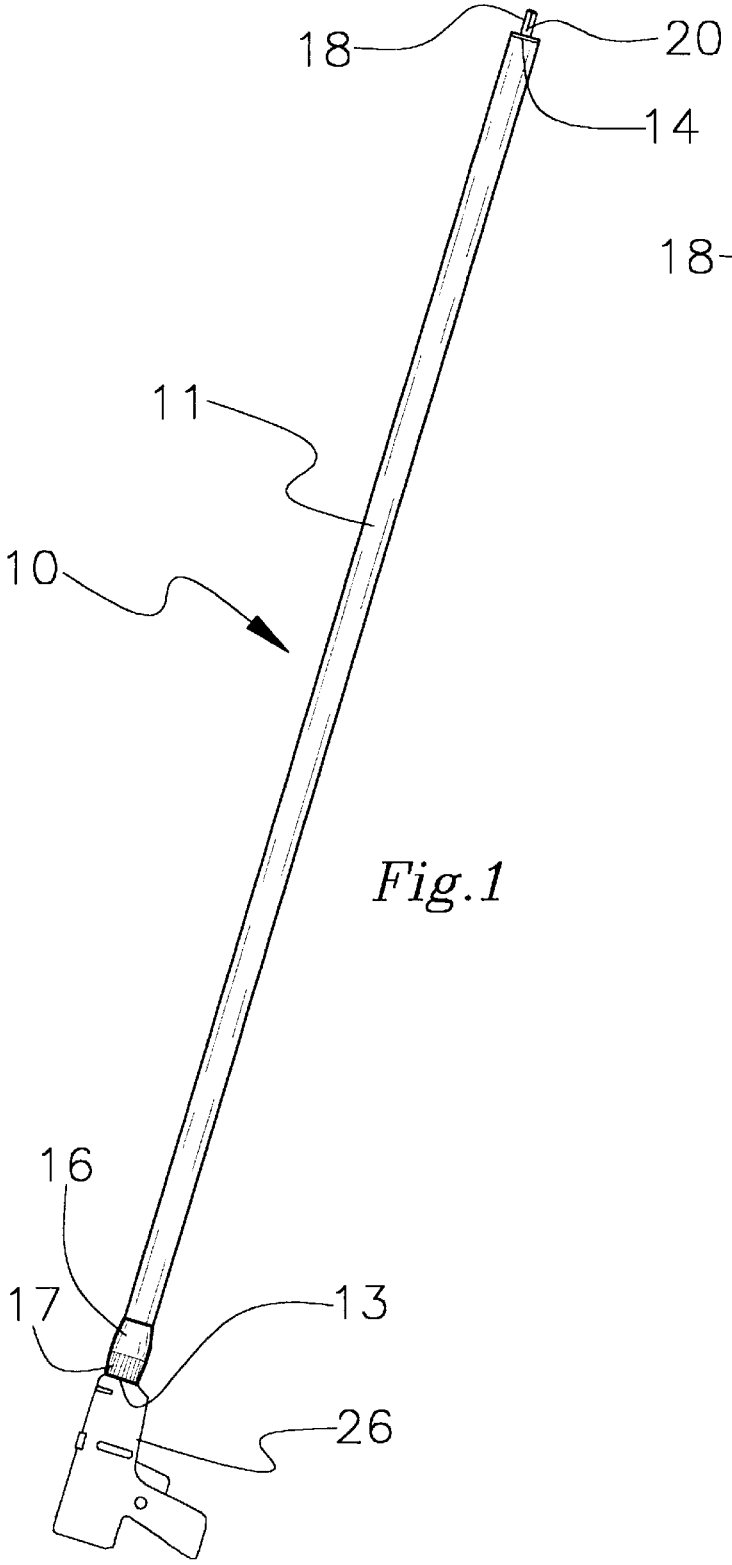
FIG. 1 is a schematic side view of a new screwgun extension in use attached to a screwgun according to the present invention.
Figure 2:
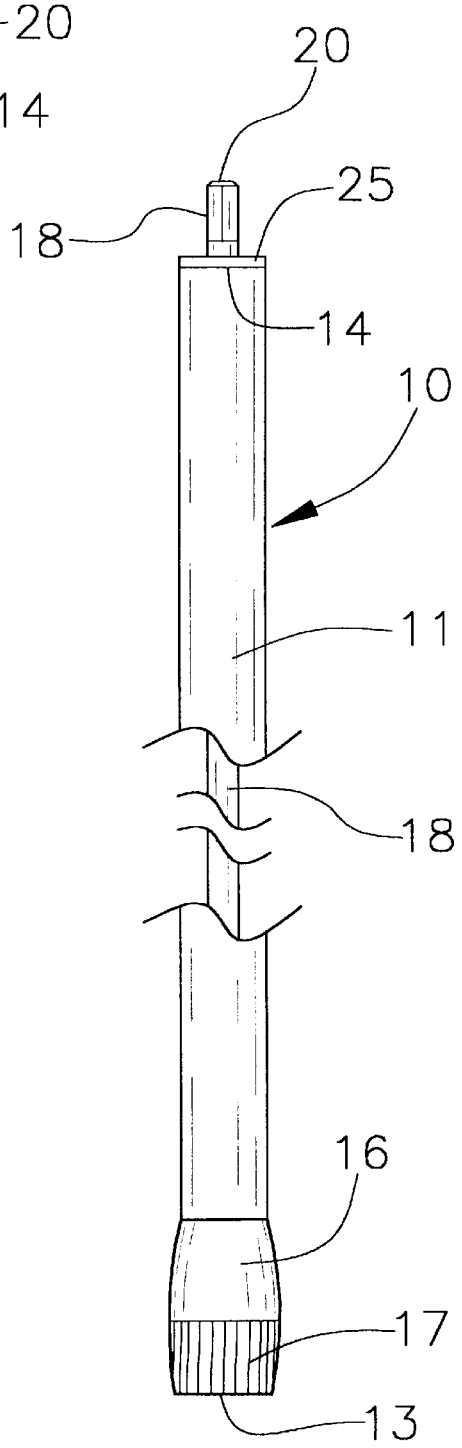
FIG. 2 is a schematic breakaway view of the present invention to illustrate the drive shaft in the tube.

With reference now to the drawings, and in particular to FIGS. 1 through 6 thereof, a new screwgun extension embodying the principles and concepts of the present invention will be described.

As best illustrated in FIGS. 1 through 6, the screwgun extension generally comprises an elongate tube with opposite open proximal and distal ends. The proximal end of the tube is designed for receiving a chuck of a rotary tool. The tube has an arcuate bulbous collar adjacent the proximal end of the tube which has a convex outer surface outwardly extending from the exterior surface of the tube. An elongate drive shaft is disposed in the lumen of the tube. A first end of the drive shaft is extended towards the proximal end of the tube. A second end of drive shaft is outwardly extended from the distal end of the tube The first end of the drive shaft is designed for clamping between jaws of a chuck of a rotary tool inserted into the proximal end of the tube such that rotation of the chuck rotates the drive shaft. A bushing is inserted into the distal end of the tube and disposed around the drive shaft. The second end of the shaft is designed for engaging a head of a fastener to permit rotation of the fastener when the drive shaft is rotated.

In closer detail, the extension comprises a generally cylindrical elongate tube 10 having an exterior surface 11, a lumen 12, opposite open proximal and distal ends 13,14 and a longitudinal axis extending between the proximal and distal ends. The tube has a length defined along the longitudinal axis of the tube between the proximal and distal ends of the tube. In an ideal illustrative embodiment, the length of the tube is about 64 inches so that a user on the ground may generally reach screws on a ceiling about 10 feet above the ground surface on which the user stands. The tube has a generally circular transverse cross section taken substantially perpendicular to the longitudinal axis of the tube with an outer diameter taken substantially perpendicular to the longitudinal axis of the tube ideally about 1 inch. In the ideal embodiment, the tube comprises stainless steel.

Figure 3:
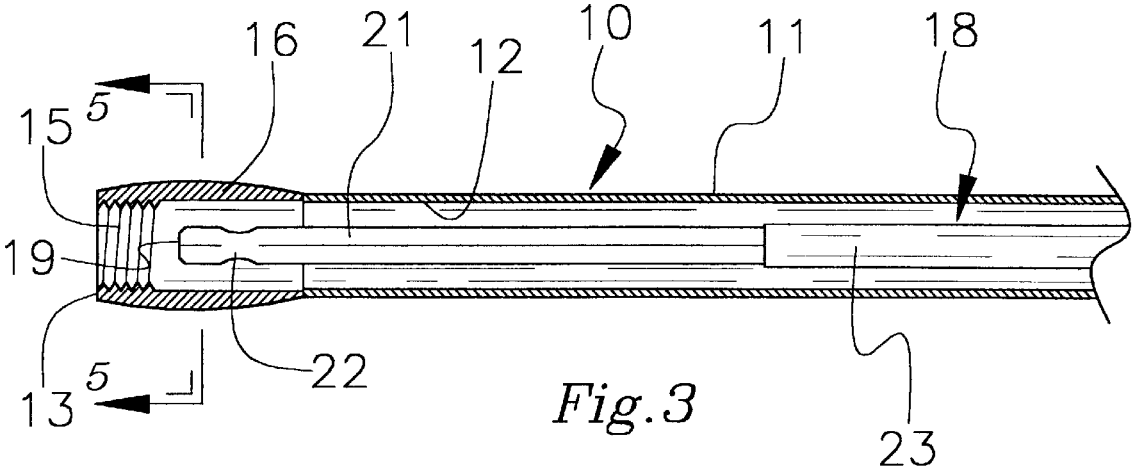
FIG. 3 is a schematic cross sectional view of the proximal end region of the present invention.
Figure 4:
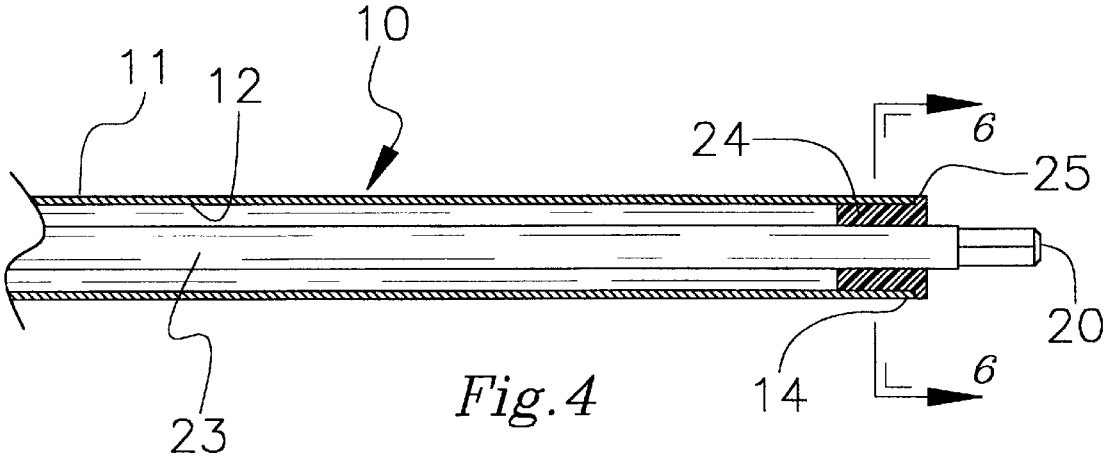
FIG. 4 is a schematic cross sectional view of the distal end region of the present invention.

As best illustrated in FIG. 3, the lumen of the tube has a threaded region 15 adjacent the proximal end of the tube. In use, the proximal end of the tube is designed for receiving a rotating chuck of a rotary tool therein. The threaded region of the lumen of the tube is designed for threaded coupling to a threaded ring of the rotary tool extending around the chuck of the rotary tool to the threaded region of the lumen of the tube while permitting free rotation of the chuck in the lumen of the tube.

The tube has an arcuate bulbous collar 16 adjacent the proximal end of the tube. The bulbous collar has a convex outer surface outwardly extending from the exterior surface of the tube. Ideally, the bulbous collar comprises a resilient plastic material. The bulbous collar has a length defined along the longitudinal axis of the tube. Similarly, the threaded region of the lumen of the tube has a length defined along the longitudinal axis of the tube. Preferably, the length of the bulbous collar is at least two times greater than the length of the threaded region of the lumen. Ideally, the length of the bulbous collar is about four times greater than the length of the threaded region of the lumen. In an ideally illustrative embodiment, the length of the bulbous collar is about 2 inches such that the length of the threaded region of the lumen is about ½ inch.

The bulbous collar has a maximum thickness defined substantially perpendicular to the longitudinal axis of the tube between the lumen and an outermost point on the outer surface of the bulbous collar. The tube has a thickness defined substantially perpendicular to the longitudinal axis of the tube between the lumen and the exterior surface of the tube. The thickness of the bulbous collar is greater than the thickness of the tube for providing reinforcement to the proximal end of the tube.

The bulbous collar preferably has a plurality of longitudinal grooves 17 therearound adjacent the proximal end of the tube. The longitudinal grooves is extended generally parallel to longitudinal axis of the tube. Ideally, each of the longitudinal grooves has a length defined along the longitudinal axis of the tube of about one-third the length of the bulbous collar. In use, the longitudinal grooves of the tube are designed for frictionally enhancing the outer surface of the bulbous collar for aiding the grip of a user grasping the bulbous collar to turn the tube to remove or attach the tube to the chuck of the rotary tool.

An elongate drive shaft 18 is disposed in the lumen of the tube. The drive shaft has a pair of opposite ends 19,20 and a longitudinal axis extending between the ends of the drive shaft. A first of the ends 19 of the drive shaft is extended towards the proximal end of the tube and is positioned in the bulbous collar of the tube. A second of the ends 20 of drive shaft is outwardly extended from the distal end of the tube. The longitudinal axes of the tube and the drive shaft are generally coaxial with one another.

Figure 5:
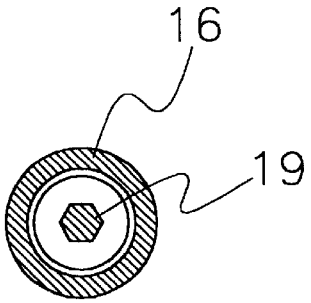
FIG. 5 is a schematic cross sectional view of the present invention taken at line 5—5 on FIG. 3.

In use, the first end of the drive shaft is designed for clamping between jaws of a chuck of a rotary tool inserted into the proximal end of the tube such that rotation of the chuck rotates the drive shaft. Preferably, the first end of the drive shaft has a generally hexagonal transverse cross section taken substantially perpendicular to the longitudinal axis of the drive shaft as illustrated in FIG. 5. The hexagonal transverse cross section of the first end of the drive shaft is designed for is securely clamped between the jaws of the chuck of a rotary tool.

Figure 6:
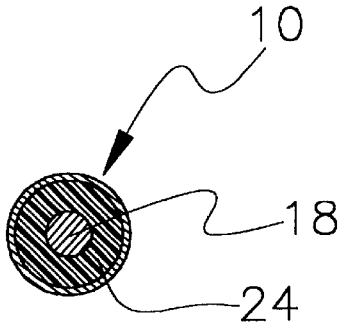
FIG. 6 is a schematic cross sectional view of the present invention taken at line 6—6 of FIG. 4.

The drive shaft preferably has first region 21 adjacent the first end of the drive shaft having a generally rectangular transverse cross section taken substantially perpendicular to the longitudinal axis of the drive shaft. In this preferred embodiment, the drive shaft has a generally circular constriction 22 between the first end and the first region of the drive shaft. The drive shaft also preferably has a second region 23 located between the first region and the second end of the drive shaft. As best illustrated in FIG. 6, the second region of the drive shaft has a generally circular transverse cross section taken substantially perpendicular to the longitudinal axis of the drive shaft. The first and second regions of the drive shaft each have lengths defined along the longitudinal axis of the drive shaft. Preferably, the length of the second region of the drive shaft is at least about four times greater than the length of the first region of the drive shaft.

A generally cylindrical bushing 24 is inserted into the distal end of the tube such that the bushing is frictionally held in the lumen of the tube. The bushing has a generally cylindrical bore therethrough. The drive shaft is extended through the bore of the bushing such that the bushing is disposed around a portion of the second region of drive shaft and the second end of the drive shaft outwardly extends from the bushing. In use, the bushing is designed for holding the drive shaft substantially coaxial with the tube. The bushing preferably has an generally circular outwardly radiating flange 25 abutting the distal end of the tube. In use, the flange is designed for helping hold the bushing in place in the tube.

In use, the second end of the shaft is designed for engaging a head of a fastener such as a screw to permit rotation of the fastener when the drive shaft is rotated about the longitudinal axis of the drive shaft by the chuck of the rotary tool. In one ideal embodiment, the second end of the shaft has a generally hexagonal transverse cross section substantially perpendicular to the longitudinal axis of the drive shaft designed for insertion into a hex shaped screw drive. It is also noted that the second end may shaped to fit into various screw drives including a slotted screw drive, a Phillips screw drive or other type of screw drive.

In use, the chuck of a screwgun 26 is inserted into the proximal end of the tube so that the first end of the drive shaft may be clamped between the jaws of the chuck. The tube is then threaded onto the screwgun to hold the tube against rotation. When the chuck is rotated by the screwgun, the chuck in turn rotates the drive shaft to rotate the second end of the drive shaft extending outwardly from the distal end of the tube to permit turning of a screw spaced apart from the use the distance of the tube.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An extension for attachment to a rotating chuck of a rotary tool, said extension comprising:

an elongate tube being generally cylindrical and having an exterior surface, a lumen, opposite open proximal and distal ends and a longitudinal axis extending between said proximal and distal ends;

said tube having a length defined along said longitudinal axis of said tube between said proximal and distal ends of said tube;

said tube having a generally circular transverse cross section taken substantially perpendicular to said longitudinal axis of said tube;

said lumen of said tube having a threaded region adjacent said proximal. end of said tube;

said proximal end of said tube being adapted for receiving a chuck of a rotary tool therein, said threaded region of said lumen of said tube being adapted for threaded coupling to a threaded ring of the rotary tool extending around the chuck of the rotary tool to said threaded region of said lumen of said tube while permitting free rotation of said chuck in said lumen of said tube;

said tube having an arcuate bulbous collar adjacent said proximal end of said tube, said bulbous collar having a convex outer surface outwardly extending from said exterior surface of said tube;

said bulbous collar having a length defined along said longitudinal axis of said tube, said threaded region of said lumen of said tube having a length defined along said longitudinal axis of said tube;

wherein said length of said bulbous collar is about 2 inches such that said length of said threaded region of said lumen is about ½ inch;

said bulbous collar having a maximum thickness defined substantially perpendicular to said longitudinal axis of said tube between said lumen and said outer surface of said bulbous collar, said tube having a thickness defined substantially perpendicular to said longitudinal axis of said tube between said lumen and said exterior surface of said tube;

wherein said thickness of said bulbous collar is greater than said thickness of said tube for providing reinforcement to the proximal end of said tube;

said bulbous collar having a plurality of longitudinal grooves therearound adjacent said proximal end of said tube, said longitudinal grooves being extended generally parallel to longitudinal axis of said tube;

wherein each of said longitudinal grooves has a length defined along said longitudinal axis of said tube of about one-third said length of said bulbous collar;

said longitudinal grooves of said tube being adapted for frictionally enhancing grippability of said outer surface of said bulbous collar by a user grasping said bulbous collar to turn said tube during removal and attachment of said tube to the chuck of the rotary tool;

an elongate drive shaft being disposed in said lumen of said tube, said drive shaft having a pair of opposite ends and a longitudinal axis extending between said ends of said drive shaft;

a first of said ends of said drive shaft being extended towards said proximal end of said tube and being positioned in said bulbous collar of said tube;

a second of said ends of drive shaft protruding outwardly beyond said distal end of said tube;

said longitudinal axes of said tube and said drive shaft being generally coaxial with one another;

said first end of said drive shaft being adapted for clamping between jaws of a chuck of a rotary tool inserted into said proximal end of said tube such that rotation of said chuck rotates said drive shaft;

said first end of said drive shaft having a generally hexagonal transverse cross section taken substantially perpendicular to said longitudinal axis of said drive shaft;

said drive shaft having first region adjacent said first end of said drive shaft, said first region of said drive shaft having a generally rectangular transverse cross section taken substantially perpendicular to said longitudinal axis of said drive shaft;

said drive shaft having a generally circular constriction between said first end and said first region of said drive shaft;

said drive shaft having a second region located between said first region and said second end of said drive shaft, said second region of said drive shaft having a generally circular transverse cross section taken substantially perpendicular to said longitudinal axis of said drive shaft;

said first and second regions of said drive shaft each having a length defined along said longitudinal axis of said drive shaft, wherein said length of said second region of said drive shaft is at least about four times greater than said length of said first region of said drive shaft;

a generally cylindrical bushing being inserted into said distal end of said tube such that said bushing is frictionally held in said lumen of said tube;

said bushing having a generally cylindrical bore therethrough, said drive shaft being extended through said bore of said bushing such that said bushing is disposed around a portion of said second region of drive shaft and said second end of said drive shaft outwardly extends from said bushing;

said bushing having an outwardly radiating flange abutting said distal end of said tube, said flange being adapted for helping hold said bushing in place in said tube;

said bushing being for holding said drive shaft substantially coaxial with said tube said second end of said shaft being adapted for engaging a head of a fastener to permit rotation of said fastener when said drive shaft is rotated about said longitudinal axis of said drive shaft; and wherein said second end of said shaft has a generally hexagonal transverse cross section substantially perpendicular to said longitudinal axis of said drive shaft adapted for insertion into a hex shaped screw drive.

* * * * *